US009615616B2

(12) United States Patent
Corrado et al.

(10) Patent No.: US 9,615,616 B2
(45) Date of Patent: Apr. 11, 2017

(54) SURGICAL CONVERTIBLE BRA

(71) Applicant: Golda, Inc., Beachwood, OH (US)

(72) Inventors: Mark W. Corrado, Shaker Heights, OH (US); Donald R. Burck, Orange Village, OH (US)

(73) Assignee: Golda, Inc., Beachwood, OH (US)

( * ) Notice: Subject to any disclaimer, the term of this patent is extended or adjusted under 35 U.S.C. 154(b) by 0 days.

(21) Appl. No.: 14/666,711

(22) Filed: Mar. 24, 2015

(65) Prior Publication Data

US 2016/0278461 A1 Sep. 29, 2016

(51) Int. Cl.

| | |
|---|---|
| ***A41F 15/00*** | (2006.01) |
| ***A41C 3/00*** | (2006.01) |
| ***A41C 3/02*** | (2006.01) |

(52) U.S. Cl.

CPC ..... *A41F 15/002* (2013.01); *A41C 3/0064* (2013.01); *A41C 3/02* (2013.01)

(58) Field of Classification Search

CPC ..... A41C 3/00; A41C 3/0028; A41C 3/005; A41F 5/002

USPC ..... 450/54–57, 86, 88

See application file for complete search history.

(56) References Cited

U.S. PATENT DOCUMENTS

| | | | | |
|---|---|---|---|---|
| 6,086,451 | A * | 7/2000 | Fernandes | A41F 15/002 2/67 |
| 7,507,141 | B2 * | 3/2009 | Ward | A41F 15/002 2/69 |
| 2003/0232573 | A1 * | 12/2003 | Plew | A41C 3/00 450/86 |
| 2011/0318990 | A1 * | 12/2011 | Bodnar | A41C 3/005 450/58 |
| 2013/0084776 | A1 * | 4/2013 | Walsh | A41C 3/0028 450/57 |

* cited by examiner

*Primary Examiner* — Gloria Hale

(74) *Attorney, Agent, or Firm* — Renner, Kenner, Greive, Bobak, Taylor & Weber Co., L.P.A.

(57) ABSTRACT

A therapeutic bra and its method of use are presented. The therapeutic bra is intended for use by individuals recovering from shoulder surgery or otherwise having areas of discomfort in the shoulder region. A single strap is provided for interconnection above the cup of the bra that is associated with the non-sensitive, unaffected shoulder. The strap extends across the unaffected shoulder and then makes interconnection with any of various receiving sleeves along a top edge of the back portion of the bra. The receiving sleeve employed will typically be a function of the anatomy of the user and the associated cup size. The single bra strap may be connected around the neck of the user and to the top of each of the cups of the bra to be used as a halter, or the strap can be totally removed and not used at all.

10 Claims, 6 Drawing Sheets

SURGICAL CONVERTIBLE BRA

TECHNICAL FIELD

The invention herein resides in the art of wearing apparel and, more particularly, to bras or brassieres typically worn as undergarments. Specifically, the invention relates to a surgical convertible bra in which a single bra strap is employed in various configurations of interconnections with the bra to avoid sensitive areas around the shoulder, neck or back of the wearer while maintaining the support and comfort desired of such apparel.

BACKGROUND ART

Customarily, bras are configured of a unitary piece of material, either formed from a single piece or of multiple pieces sewn and interconnected together. The ends of the unitary piece of material are adapted to be joined together in secure engagement either at the middle of the back of the wearer or the center chest area of the wearer, between the bra cups. In either event, the typical bra has a pair of straps, one connected near the top of each cup and extending over the shoulder of the wearer and interconnected at the back portion of the bra.

When the wearer has tenderness in the shoulder area, the bra strap crossing that area can be exceedingly uncomfortable, not only causing pain to the wearer, but also hindering any recovery or healing of that tender area. For example, if a woman has had surgery on her shoulder, neck, rotator cuff region or the like, the placement of a bra strap over that region during the healing and recovery period can become problematic both as to comfort and to the healing process itself. Accordingly, there is a need in the art for a therapeutic bra that may be worn during times when an individual is experiencing areas of sensitivity as a consequence of surgical or medical procedures or otherwise and where those areas of sensitivity lie in the region where a bra strap would normally cross.

SUMMARY OF THE INVENTION

In light of the foregoing, it is a first aspect of the invention to provide a therapeutic bra that is adaptable and convertible to configurations accommodating placement of the bra strap.

Other aspects of the invention are achieved by a therapeutic bra in which a single bra strap may be used in conjunction with a bra having multiple connection points such that the wearer may use the bra in a manner conducive to comfort and support without aggravating any otherwise painful region in the wearer's neck and shoulder area.

Still further aspects of the invention are achieved by a therapeutic bra in which the bra may be worn strapless, as a halter-type bra, or as a single-strap bra, whichever is most conducive to comfort and support.

Still a further aspect of the invention is the provision of a therapeutic bra having multiple points of interconnection for placement of a bra strap to accommodate any of numerous configurations of the bra as it is applied to the body to maximize comfort and support while accommodating any attendant healing process or avoiding any discomfort zone.

The foregoing and other aspects of the invention are achieved by a therapeutic bra, comprising: a continuous band of elastic material having a continuous back portion and a pair of cup portions, one such cup portion at each end of said back portion; mating portions of a fastener along lateral edges of each said cup portion; and a single strap selectively engageable between said cup portions or a selected one of said cup portions and any one of a plurality of selectable locations on said back portion.

Other aspects of the invention that will become apparent herein are achieved by a method for placing a bra on an individual while avoiding sensitive areas of the body resulting from surgery, other medical treatment, or malady, comprising the steps of: securing together the ends of an elongated piece of material about an individual's torso, said elongated piece of material having a pair of cups and a back body portion interposed therebetween; and interconnecting a strap between top portions of said pair of cups or from a top portion of one of said cups to a selected one of a plurality of locations along a top edge of said back body portion, said selected interconnection of said strap establishing a path for said strap that avoids the sensitive areas while providing comfort and support to the individual.

DESCRIPTION OF DRAWINGS

For a complete understanding of the various aspects of the invention, reference should be made to the following detailed description and accompanying drawings, wherein.

DETAILED DESCRIPTION OF PREFERRED EMBODIMENT

Figure 1:
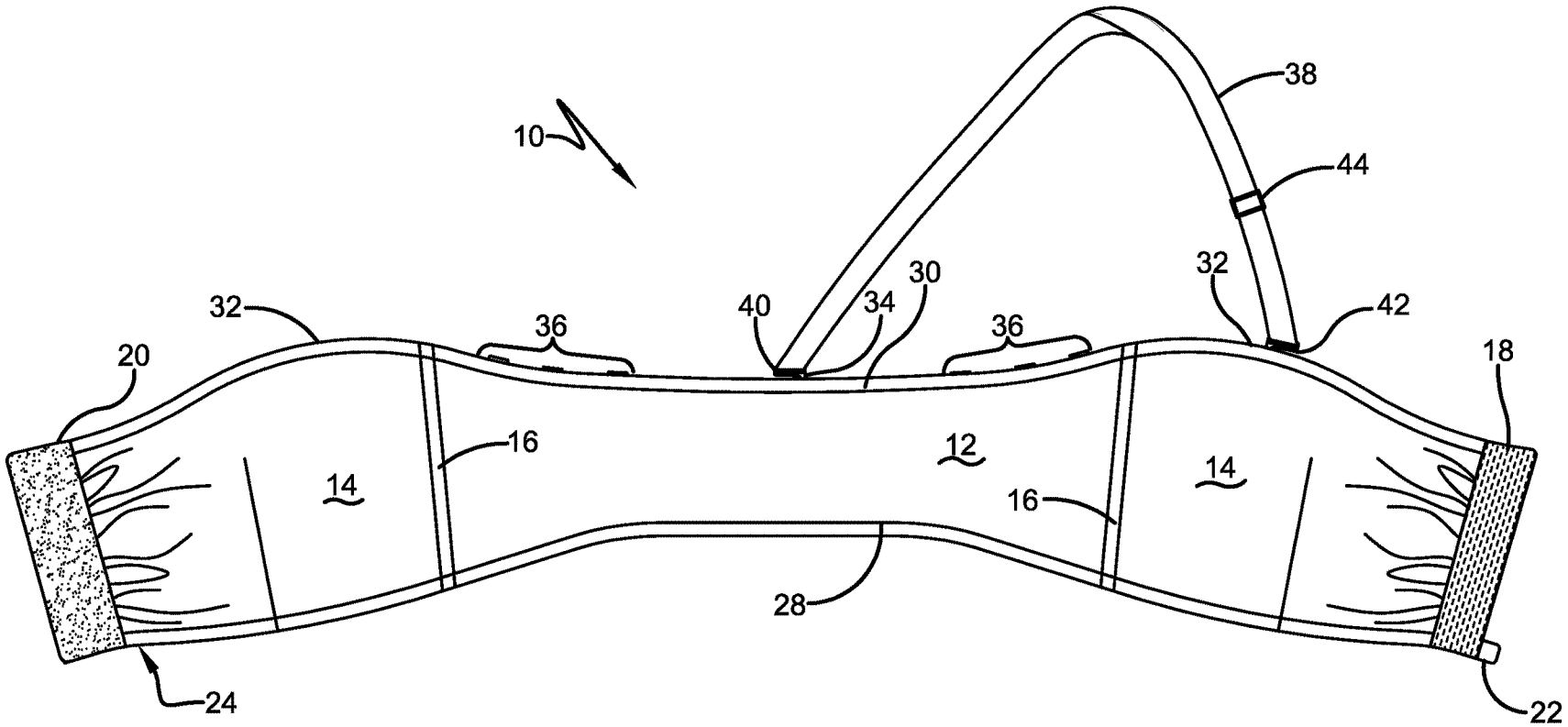
FIG. 1 is a front view of a therapeutic bra made in accordance with the invention.
Figure 2:
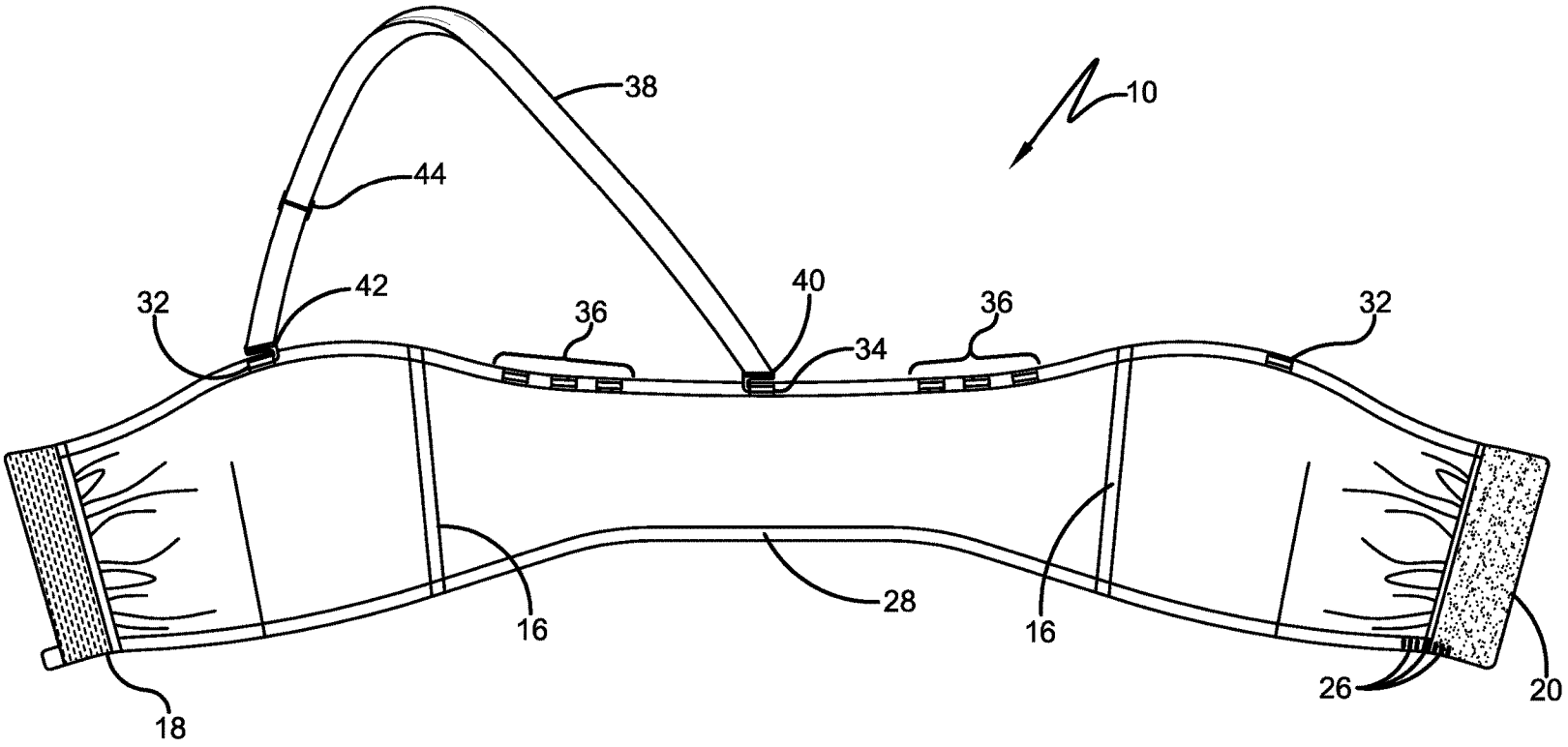
FIG. 2 is a back view of the bra of FIG. 1.

Referring now to the drawings and more particularly to FIGS. 1 and 2, it can be seen that an adjustable single strap therapeutic bra made in accordance with the invention is designated generally by the numeral 10. The bra 10 has a back body portion 12 extending to a pair of cup portions 14 on each side of the body portion 12 with appropriate seams 16 and the like to either secure together individual pieces for making up the unitary assembly 10 or for securing and maintaining in place appropriate padding and the like. It will be appreciated that the back body portion 12 and the cup portions 14 are preferably made of a stretchable or expandable material, such as a nylon-spandex blend, being on the order of between 90% nylon and 10% spandex, to about 70% nylon and 30% spandex, with the most preferable range being 80% nylon and 20% spandex.

Appropriate fasteners 18, 20 are positioned at the end edges of the cup portions 14 in order that the bra may be joined together in an encompassing fashion between the cups 14. According to a preferred embodiment of the invention, a fastener 18, 20 consists of mating hook-and-loop pieces that mate upon contact and which are extremely secure in shear/tension in an orientation parallel to their interengagement.

A fastener 22, such as a hook or the like, is provided at a lower end of one of the mating portions 18, 20, while the lower end of the other mating portion is characterized by receiving sleeves 24 formed by material being overlaid along the top of the edge portion with stitches 26 forming receiving slots therebetween. The hook-like fastener 22 is adapted to be received by the appropriate receiving sleeve 24 depending upon the size of the wearer. Accordingly, there is a hook-and-loop fastening of the bra by means of elements 18, 20, and a latching of the ends of the bra by means of the fastener 22 being engaged with an appropriate receiving sleeve 24 formed between the stitches 26.

Elastic bands are maintained within the hemmed bottom edge 28 extending along the bottom portion of body portion 12 and cup portions 14, while a similar elastic band is maintained within the hemmed top edge 30. Positioned above each of the cups 14 is a receiving sleeve 32 formed from an appropriate material and positioned at the hem 30. At the top center of the back body portion 12 and attached to the hem 30 is a centrally positioned receiving sleeve 34 similar to the receiving sleeve 32. Additionally, along the back portion 12 and in association with hemmed region 30, there are sets of receiving sleeves 36 laterally displaced from the sleeve 34 and on each side thereof. While there might be any number of sleeves 36 in each set, it is contemplated that three sleeves spaced on the order of an inch apart are sufficient.

As further shown in FIGS. 1 and 2, a bra strap 38 has a hook-type fastener 40 connected as by stitching or the like to one end thereof. The opposite end of the strap 38 is looped through a similar hook-type fastener 42 with the end of the strap 38 being connected to an adjustment slide 44 in somewhat standard fashion. The hooks 40, 42 are configured so as to be readily received by the receiving sleeve 32, 34, 36, as will become apparent below.

It will also be apparent that the adjustment slide 44 is positioned to accommodate various sizes of users.

Figure 3:
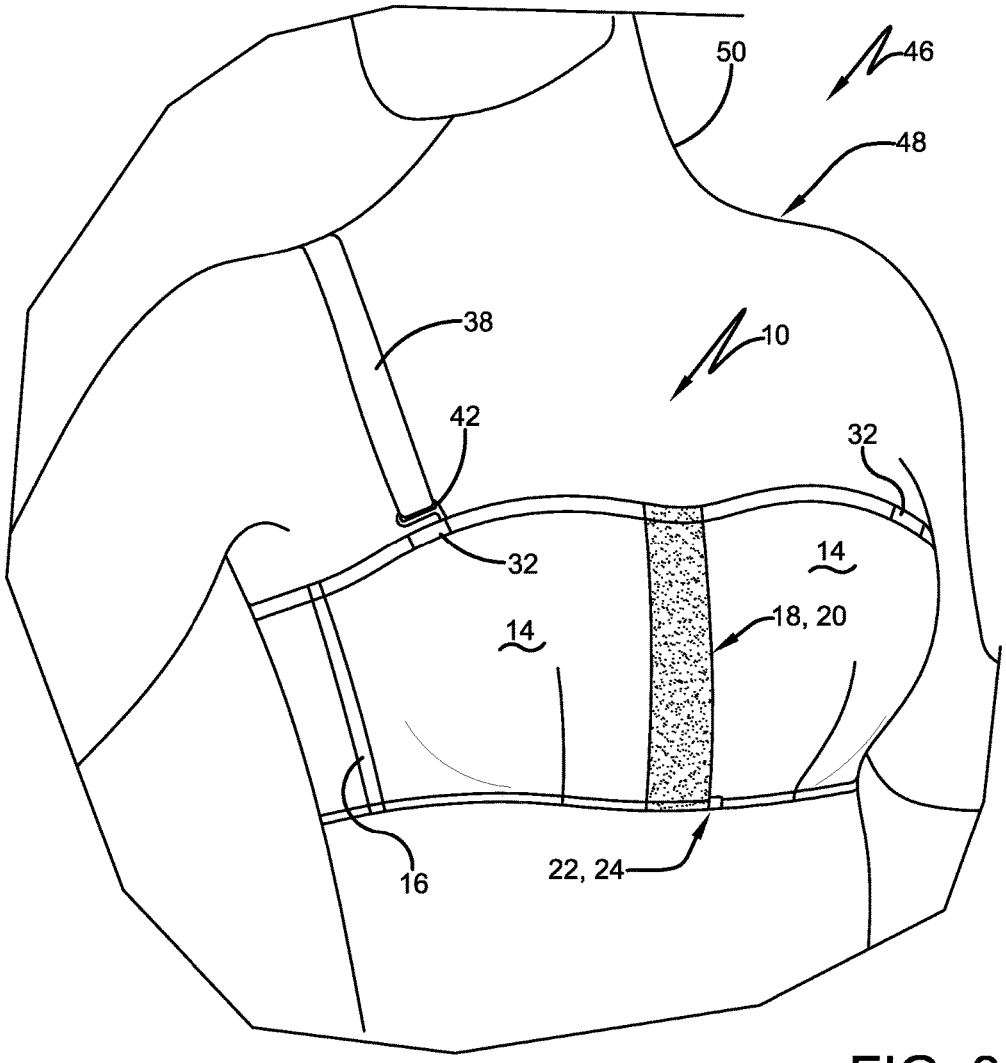
FIG. 3 is an illustrative view of the therapeutic bra of the invention as viewed from the front of the wearer.

With reference now to FIG. 3, a front illustration of an individual wearing the adjustable therapeutic bra 10 is shown and designated by the numeral 46. Of particular interest here is the shoulder area 48 of the individual 46, with the area 48 being a sensitive region as a result of surgery, medical issues, or other maladies. As shown in FIG. 3, the therapeutic bra 10 may be employed to avoid the sensitive shoulder area 48 (the left shoulder of the individual), by causing the single strap 38 to pass only over the right shoulder of the individual. The attachment of the strap 38 is effected by means of the interconnection of the hook fastener 42 with the receiving sleeve 32 over the right cup 14.

Figure 4:
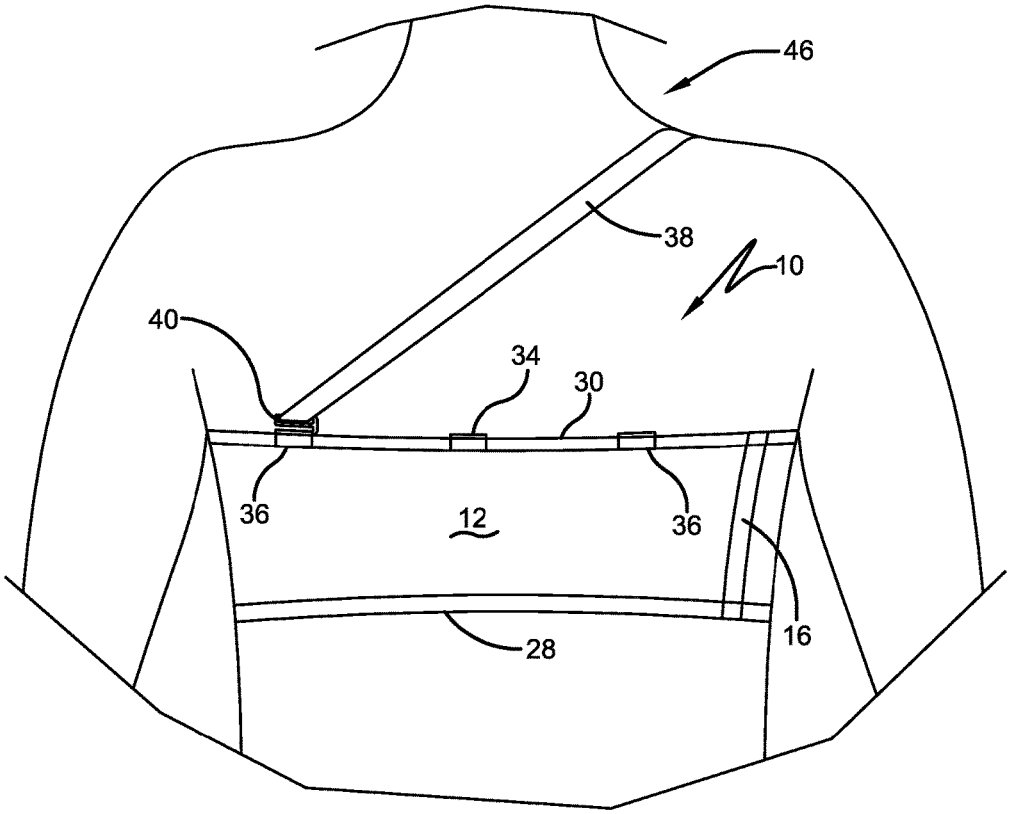
FIG. 4 is an illustrative view of the therapeutic bra of the invention in use on a wearer with the strap interconnected in a first position.
Figure 5:
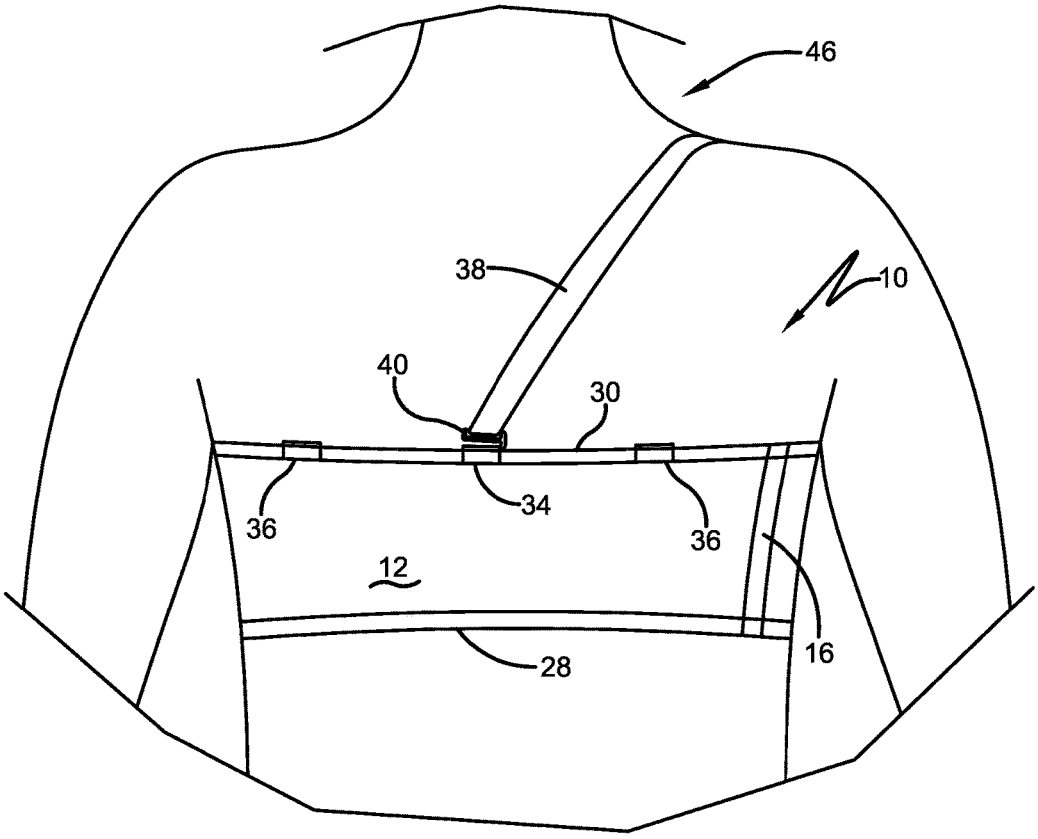
FIG. 5 is an illustrative view of the therapeutic bra of the invention in use on a wearer with the strap interconnected in an intermediate second positon.
Figure 6:
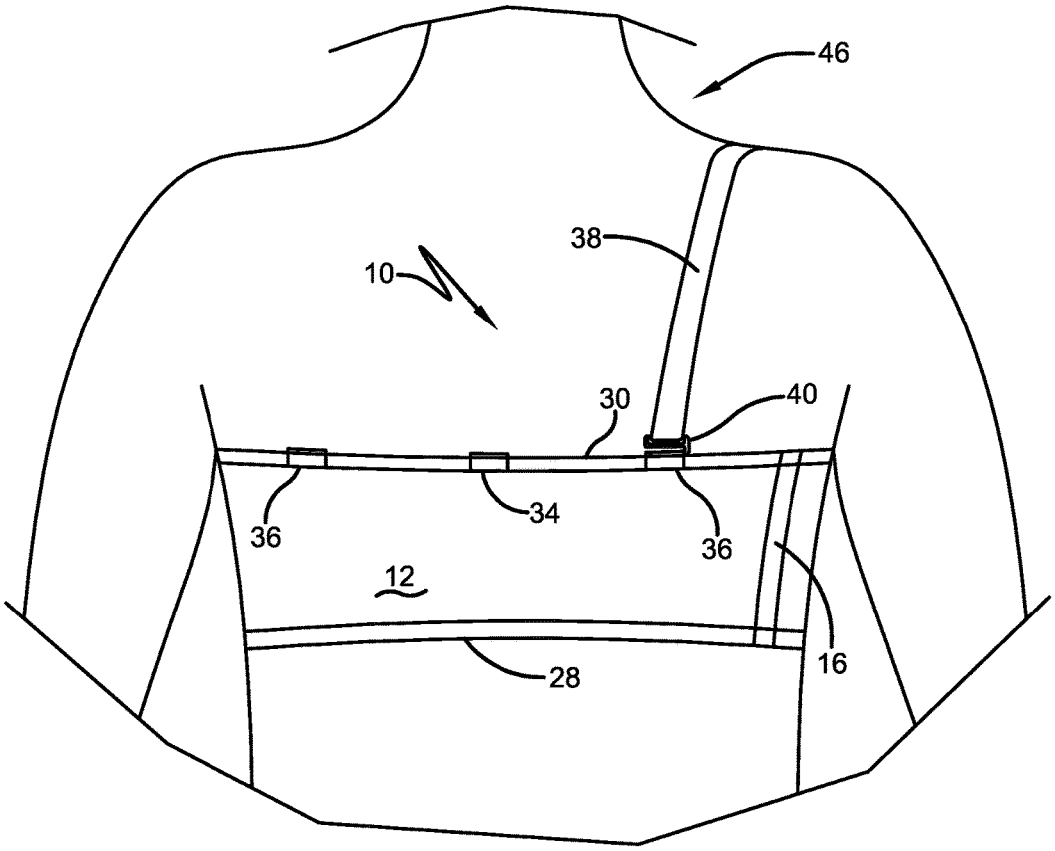
FIG. 6 is an illustrative view of the therapeutic bra of the invention in use on a wearer with the strap interconnected to a position closest to the front connection of the bra.

As shown in FIGS. 4-6, the hook fastener 40 at the opposite end of the strap 38 may be connected to an appropriate one of the end receiving sleeves 36 or central receiving sleeve 34 as shown in those drawings. For larger cup sizes, the diagonal extension of the strap 38 will be greater, while for smaller cup sizes the diagonal extension will be less or even more of a straight alignment. For example, for a small cup size, the back connection may be made as shown in FIG. 6, where the strap 38 simply extends in somewhat straight-line fashion from the top of the right cup over the right shoulder and to the sleeve 36 beneath the right shoulder. For a larger cup size, the back interconnection may be made at the central receiving sleeve 34, while the strap 38 may extend from above the right cup, across the right shoulder, and diagonally across the back to the left-most receiving sleeve 36 for even larger cups. Of course, as shown in FIGS. 1 and 2, there may be multiple sleeves provided in the region 36 for fine adjustment of the therapeutic bra.

It has been found that even for larger cup sizes, the single strap is sufficient for uniform support of both cups. In the illustration shown, the right cup is supported by the strap directly above the cup, while the left cup is supported by the attachment of the hook connector 40 to the left-most sleeve 36, as shown in FIG. 4. The integrity of the bra, as a unitary construction, translates into the support of the left cup through the attachment of the strap at the left receiving sleeve 36.

The invention also contemplates that for extremely large or full cups, the strap 38 may be employed as a halter, with the ends thereof being connected to the sleeves 32 above each cup, with the strap going around the back of neck of the individual using it. This halter-type connection employs only the receiving sleeves 32 above each cup with the support being made directly at the top of each cup and, again, without any irritating forces being applied to the shoulder area 48, but only about the neck 50 of the user.

The invention also contemplates that the therapeutic bra 10 may be used in a totally strapless mode, where the strap 38 is not connected to either of the sleeves 32. Those skilled in the art will appreciate that whether the strap 38 is employed at all, or if it is applied in a halter-type manner simply about the back of the neck and interconnecting above each cup, or whether it is employed in a single-strap fashion connected at a first end above the cup associated with the unaffected shoulder and then connected to any of a plurality of receiving sleeves 36 will depend upon the anatomy of the user and the desired comfort and utility of the therapeutic bra.

The implementation and utilization of the bra should now be apparent to those skilled in the art. By a minimal amount of trial and error, the user can determine the desired points of interconnection of the bra strap, adjusting it with the adjustment slide 44, and making the final secured engagement by means of the hook-and-loop fasteners 18, 20 and fastener and sleeve interconnection at 22, 24. Removal and readjustment by selection of different connection points for the strap 30 may be easily achieved and, once selected, can be continuously used unless and until the need for use of the therapeutic bra ends.

Thus, it can be seen that the various aspects of the invention have been achieved by the structure presented and described above. While in accordance with the patent statutes, only the best known and preferred embodiments of the invention have been presented and described in detail, the invention is not limited thereto or thereby. Accordingly, for an appreciation of the true scope and breadth of the invention, reference should be made to the following claims.

What is claimed is:

1. A therapeutic bra, comprising:

a continuous band of elastic material having a continuous back portion and a pair of cup portions, one such cup portion at each end of said continuous back portion;

mating portions of a fastener extending continuously along lateral edges of each said cup portion;

a single strap, to the exclusion of any other straps, said single strap being selectively engageable between said cup portions or a selected one of said cup portions and any of a plurality of selectable locations on said continuous back portion.

2. The therapeutic bra as recited in claim 1, wherein said selectable locations are positioned along a top edge of said continuous back portion, each said selectable location establishing a fixed path for said single strap from said selectable location to said selected cup portion, said fixed path adapted to avoid contact with and the application of pressure to a therapeutically sensitive body region of the wearer.

3. The therapeutic bra as recited in claim 2, wherein said selectable locations comprise a central location along said continuous back portion and laterally offset locations equidistant on each side of said central location.

4. The therapeutic bra as recited in claim 3, wherein said single strap is adjustable and has a fastener at each end thereof.

5. The therapeutic bra as recited in claim 4, further comprising receiving sleeves at said cup portions and said selectable locations on said continuous back portion, said receiving sleeves adapted to receive one of said fasteners on each end of said single strap.

6. The therapeutic bra as recited in claim 5, wherein said mating portions of a fastener along lateral edges of each said cup portion comprise mating hook-and-loop materials.

7. The therapeutic bra as recited in claim 6, wherein said mating portions further comprise receiving sleeves and a hook.

8. A method for placing a bra on an individual while avoiding sensitive areas of the body resulting from surgery or other medical treatment or malady, comprising the steps of:

securing together the ends of an elongated piece of material about an individual's torso, said elongated piece of material having a pair of cups and a back body portion interposed therebetween;

interconnecting a single strap between top portions of said pair of cups or from a top portion of one of said cups to a selected one of a plurality of locations along a top edge of said continuous back body portion, said selected interconnection of said strap establishing a path for said strap that avoids the sensitive areas while providing comfort and support to the individual; and wherein no other interconnection is made between said pair of cups or between one of said pair of cups and one of said plurality of locations along said top edge of said continuous back body portion.

9. The method for placing a bra on an individual according to claim 8, further comprising the step of engaging ends of said piece of material with each other between said cups.

10. The method for placing a bra on an individual according to claim 9, wherein said step of engaging ends of said piece of material comprise mating hook-and-loop closures and engaging a fastener with a receiving sleeve.

* * * * *